US005795196A

United States Patent [19]

Hotea et al.

[11] Patent Number: 5,795,196

[45] Date of Patent: Aug. 18, 1998

[54] CONTACT HAVING AN INDEPENDENTLY SUPPORTED INNER CONTACT ARM

[75] Inventors: Gheorghe Hotea, Griesheim; Mile Trajkov, Frankfurt; Horst Gehrke, Langen, all of Germany

[73] Assignee: The Whitaker Corporation, Wilmington, Del.

[21] Appl. No.: 623,581

[22] Filed: Mar. 28, 1996

[30] Foreign Application Priority Data

Jun. 4, 1995 [DE] Germany ..... 9507187.4

[51] Int. Cl.[6] ..... H01R 13/11

[52] U.S. Cl. ..... 439/850

[58] Field of Search ..... 439/851, 852, 439/856, 857, 839, 828, 668, 845, 849, 850

[56] References Cited

U.S. PATENT DOCUMENTS

| | | | |
|---|---|---|---|
| 3,550,069 | 12/1970 | Teagno | 439/849 |
| 3,713,079 | 1/1973 | Dechelette | 339/217 R |
| 4,351,583 | 9/1982 | Belttary | 439/839 |
| 4,772,234 | 9/1988 | Cooper | 439/851 |

FOREIGN PATENT DOCUMENTS

| | | | |
|---|---|---|---|
| 0 114 187 | 8/1984 | European Pat. Off. | H01R 13/18 |
| 0 363 170 | 4/1990 | European Pat. Off. | H01R 13/11 |
| 0407249 | 1/1991 | European Pat. Off. | 439/857 |
| WO 89/05531 | 6/1989 | WIPO | H01R 13/11 |

*Primary Examiner*—Gary F. Paumen
*Assistant Examiner*—Tho D. Ta

[57] ABSTRACT

An electrical receptacle contact for engaging a complementary tab terminal (not shown) comprising a contact portion and a conductor engaging portion, where the contact portion includes a body portion and at least three contact arms including a pair of spaced-apart outer contact arms extending from the body with an inner contact arm extending therebetween and the contact arms have contact surfaces thereupon for engaging a common side of the tab terminal, the receptacle contact being characterized in that the inner contact arm is supported therealong independently of the adjacent outer contact arm by a transverse support rail to provide the inner contact arm with enhanced stiffness. The contact being of simple construction, with multiple connection points established essentially independently, where the inner contact arms are independently stiffened.

15 Claims, 3 Drawing Sheets

CONTACT HAVING AN INDEPENDENTLY SUPPORTED INNER CONTACT ARM

BACKGROUND OF THE INVENTION

1. Field of the Invention

This invention relates to electrical contacts and in particular to those electrical contacts having at least one inner contact arm disposed between a pair of outer contact arms where it is necessary to enhance the stiffness of the inner contact arm.

2. Description of the Prior Art

One common electrical contact interconnection system includes a tab contact on one side that is received by an electrical contact on the other side. The tab contact will generally have a rectangular-like cross-section and the receptacle contact will have a tab receiving region where forwardly extending contact arms converge towards opposing contact surfaces to engage a tab inserted therein. In order to form a reliable interconnection, it is necessary that the contact arms exert sufficiently high normal forces upon the tab and that a sufficient number of interconnection points are provided for the transfer of signal therebetween. This becomes a significant issue as the power of the signal becomes large.

There are numerous constructions that provide multiple contact points for engaging a mating tab terminal. These range from simple structures having a multitude of forwardly extending cantilevered contact arms to more complex structures that incorporate complicated forms having multiple contact points that engage at various locations along the length of the tab terminal. One of the problems associated with the forwardly extending contact arms is that while the outer contact arms can be formed to cooperate with the side walls of the contact to provide additional stiffness, the inner contact arms are essentially only cantilevered from the body and rely upon the material characteristics for their resiliency or must be coupled at their free forward end to the forward ends of the corresponding outer contact arms.

It is known to enhance the resiliency characteristics of forwardly extending cantilevered contact arms by providing a back-up spring which typically would involve an additional component formed as an overlying support arm extending along the contact arm such that the stiffness is now enhanced by the back-up spring arm. Back-up spring arms typically extend from a back-up spring basis which is normally a second component fitted around the body of the contact, which does not have to be of the same material as the rest of the contact as its function is primarily mechanical. A problem with this construction is that a second piece is required which ultimately leads to a more complex structure and could add to the cost of the contact.

It is also known to enhance the stiffness of the inner contact arms by incorporating their free forward ends into the corresponding ends of the supported outer contact arms. A problem with this construction is that misalignment of a mating tab terminal is not easily accommodated in a manner that assures all the contact surfaces will be engaged with the terminal, i.e. the biasing of one of the contact arms has an effect on the other interconnected contact arms. In some cases the reaction of the coupled contact arm is sufficient to cause at least one of the contact arms not to engage the tab terminal.

What is needed is to provide an electrical contact having at least three contact arms extending toward a receptacle opening wherein a tab terminal is to be received where the middle contact arm is free of an adjacent side contact arm and is provided with additional stiffness. What is further needed is that the contact be of simple construction.

SUMMARY OF THE INVENTION

The objects of this invention are accomplished by providing an electrical receptacle contact for engaging a complementary tab terminal comprising a contact portion and a conductor engaging portion with a body portion therebetween, the contact portion including a pair of spaced-apart outer contact arms extending from the body with an inner contact arm therebetween where the contact arms have contact surfaces thereupon for engaging a common side of the tab terminal, the receptacle contact being characterized in that the inner contact arm has a transversely disposed support arm extending therealong from the body and operatively cooperating with the inner contact arm to provide enhanced stiffness.

Advantageously, the present invention provides enhanced stiffening to an inner contact arm, thereby improving the normal force exerted upon a mating tab terminal. The electrical contact may also be formed from a single piece of material. In addition, the inner contact arm can be formed free of adjacent contact arms such that the inner contact arm can float relative thereto to form a more effective interconnection with the mating tab terminal.

DETAILED DESCRIPTION OF THE PREFERRED EMBODIMENT

Figure 1:
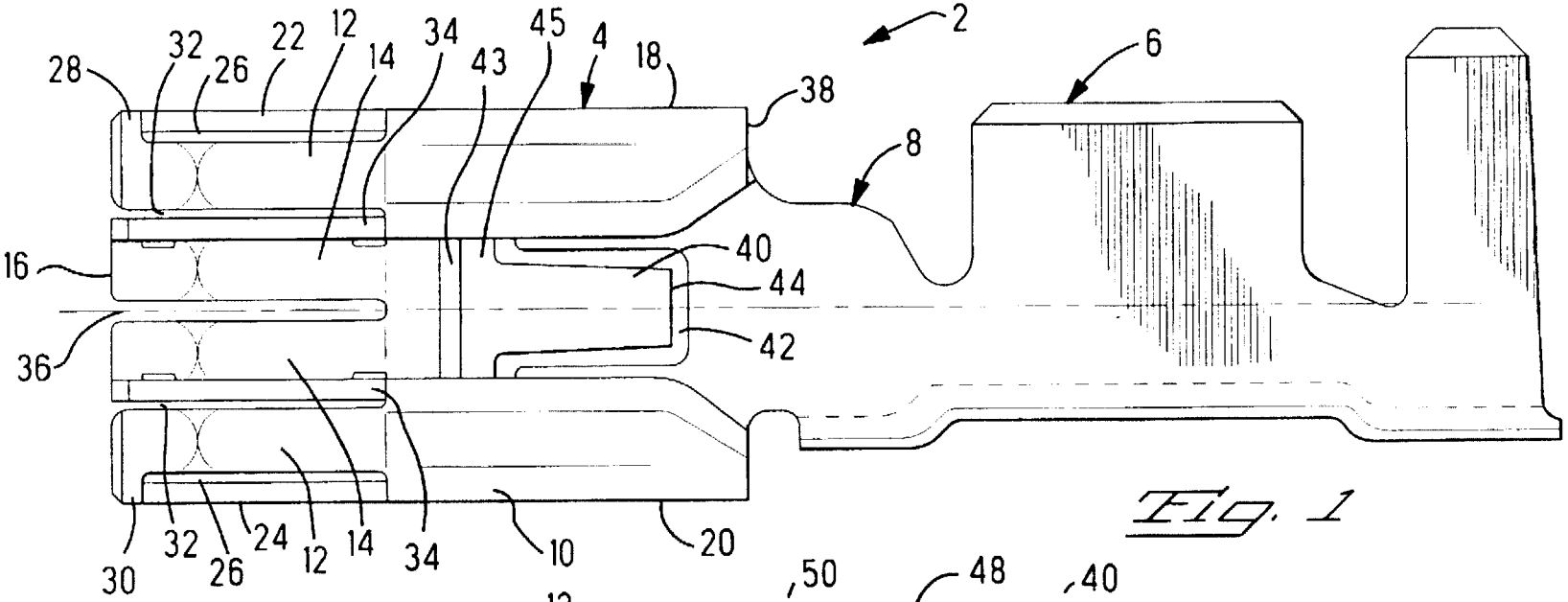
FIG. 1 is a side view of an electrical contact according to the present invention.

With reference now to FIG. 1, an electrical contact according to the present invention is shown generally at 2. The electrical contact 2 includes a contact portion 4 and a conductor engaging portion 6. In this embodiment, the conductor engaging portion 6 assumes a wire crimp configuration. The conductor engaging portion is connected to the contact portion by way of a transition section 8.

Contact portion 4 includes a body 10 from which a spaced-apart pair of outer contact arms 12 and a pair of inner contact arms 14 extend to a tab receiving end 16. The body 4 includes side walls 18,20 that have unitarily formed corresponding side rails 22,24 that extend along the outer contact arms 12. The extensions 22,24 are orientated transversely to the orientation of the contact arms 12 and separated therefrom along the length thereof by an opening 26. The transverse orientation allows the side walls 18,20 to provide a tailored stiffness as the side walls may be stamped to stiffening width independent of the thickness of the material. Opposite the body 4, towards the receptacle end 16, the contact arms 12 are joined with their respective extensions 22,24 by way of brackets 28,30 that are unitarily formed with both the contact arm 12 and its respective side extension 22,24 respectively.

Between each of the outer contact arms 12 and the inner contact arms 14 is a second opening 32, whereby the inner contact arms 14 extend outward from the body 4 towards the receptacle end 16 free of the adjacent outer contact arm 12. As the inner contact arms 14 are free of the outer contact arms 12, the inner contact arms 14 may move independently thereof to accommodate misaligned mating tab terminal, thereby assuring the maximum number of contact points possible are established across a tab terminal. Extending along each of the contact arms 14, adjacent to the openings 32 and between the inner contact arms 14 and the outer contact arms 12, are upstanding support rails 34 that extend from the body 10 transversely to the plane of the contact arms 14. These rails 34 are configured to cooperate with the inner contact arms 14 in a supporting manner therealong, as described above with respect to sides 22,24. In this embodiment, the transverse support rails 34 are unitarily formed with the contact arms 14, as is described below. The support rails 34 could however be formed in a manner that has a free end extending over the contact arms 14 in a supporting manner. Advantageously, in this embodiment, the two inner contact arms 14 are separated by central slot 36 enabling the two inner contact arms to move independently of each other. It may also be desirable to eliminate the slot 36 and provide only a single inner contact arm 14 supported on both sides by support rails 34 between the outer contact arms 12. Additionally, it may be desirable to provide additional contact arms, either supported by transverse rail sections or in an unsupported manner. These possibilities are also within the envisioned scope of the present invention.

Along the body 10 and opposite the contact arms 12,14, the contact portion 4 includes a rear edge 38 corresponding generally to the transition portion 8. This rear edge 38 is particularly suited for engagement by a secondary locking member of a connector housing (not shown) wherein the contact 2 would be seated. Also disposed along the body 10 is a locking lance 40 defined by a U-shaped opening 42 and a second opening 43 spaced therefrom and extending across the free ends of the U-shaped opening to form a band 45 therebetween. The U shaped opening 42 has its base generally corresponding to the rear edge 38 so that the locking lance 40 is cantilevered from the body 10 and folded slightly outward therefrom such that a free end 44 is formed for engaging a shoulder of a mating connector housing. As the lance 40 is cantilevered from the band 45 the resiliency is improved.

Figure 2:
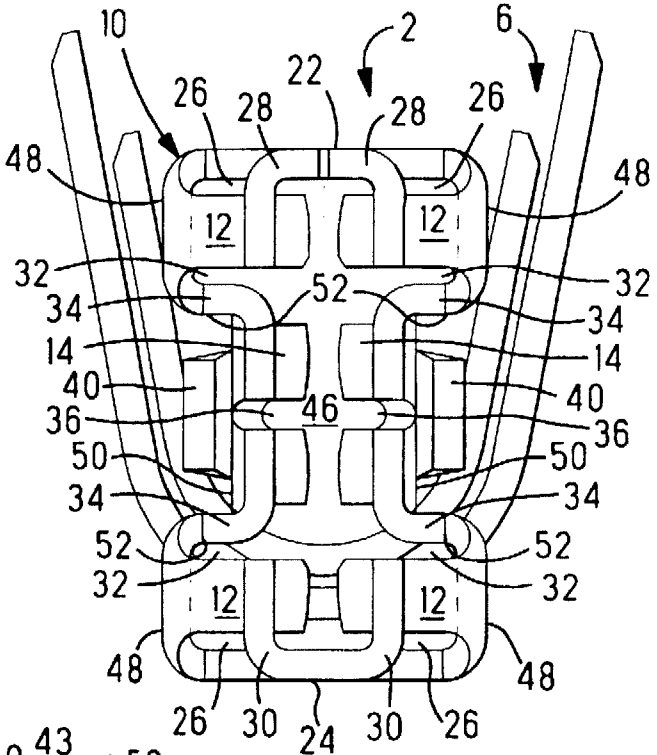
FIG. 2 is a front end view of the electrical contact of FIG. 1.

With reference now to FIG. 2, the electrical connector 2 is shown having complementary configuration shown opposite the aforedescribed to define a tab receiving region 46 accessible from a receptacle end 16 wherein the mating tab terminal is receivable and engageable by each of the contact arms 12,14 on both sides thereof. As shown in FIG. 2, the lower structure is identical and oppositely disposed to the upper structure to provide a receptacle contact. The particular structure need not be described in detail again.

As can be observed in FIG. 2, the outer contact arms 12 extend from spaced apart raised portions 48 of the body 10. The inner contact arms 14 extend from a channel portion 50 located between the raised portions 48 and recessed relative thereto. Located between the raised portions 48 and the channel portion 50 are transition sections 52. The rails 34 are formed by providing a slit along the edge of the contact arms 12, along what would correspond to the transition sections 52 and folding the resultant material between the slit and the inner contact arm 14 perpendicular thereto along to the respective contact arm 14. The locking lance 40 is located within the channel 50. The body 10, in the configuration shown in the figures where opposing similar contact structure is provided, assumes a dog-bone cross-sectional shape with the corresponding raised portions 48 forming the bulbous ends interconnected by a narrower bar-like centre defined by the opposing channel portions 50.

Figure 3:
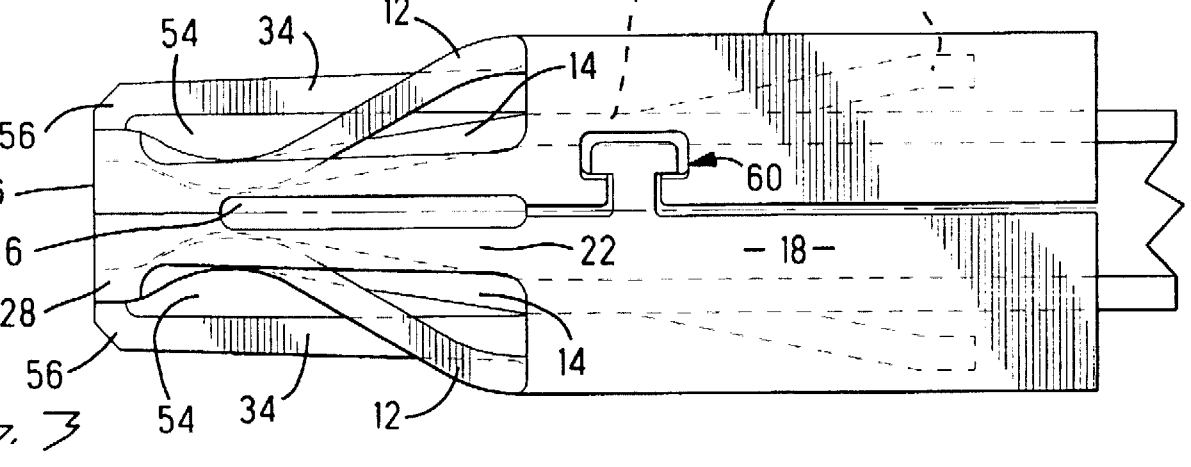
FIG. 3 is a top view of the electrical contact of FIG. 1.
Figure 4:
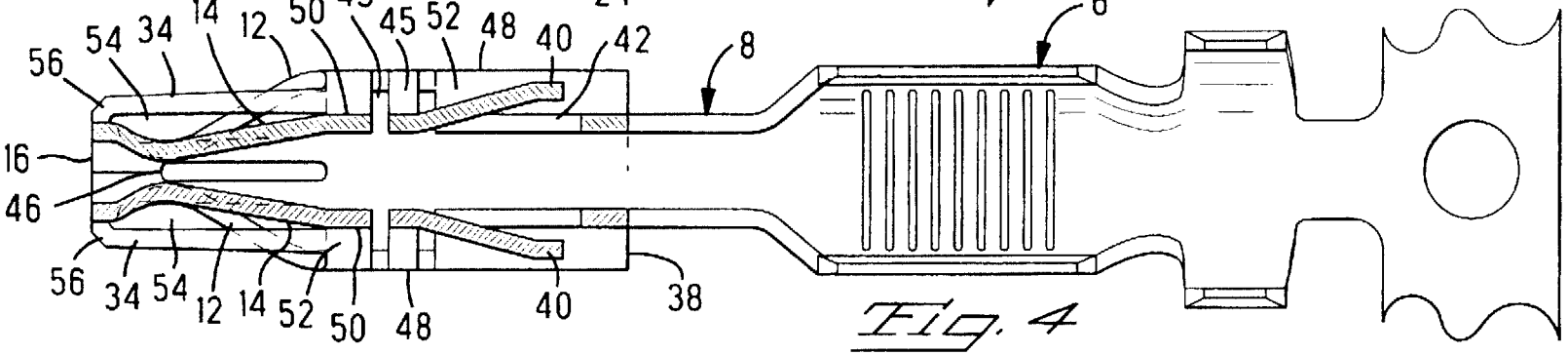
FIG. 4 is a top sectional view of the electrical contact of FIG. 1.

With reference now to FIGS. 3 and 4, the support rails 34 are shown free of the inner contact arms 14 along an opening 54 until they are adjoined therewith at a transition section 56. As can be seen in this Figure, oppositely orientated contact arms 12,14 converge toward one another to define the tab receiving region 46 wherein the contact arms 12,14 have contact surfaces thereupon. The separation of the opposing arms is constructed to be advantageous for mating with the particular tab terminal desired, as is common in industry. Furthermore, as the contact 2 is stamped and formed from a flat piece of metal the free ends of which need to be joined together in a manner that prevents expansion of the contact to assure that the contact force is maintained. In the embodiment shown a mechanical interlock is provided at 60. It may also be possible to incorporate a weld therealong to effect the joining.

Figure 5:
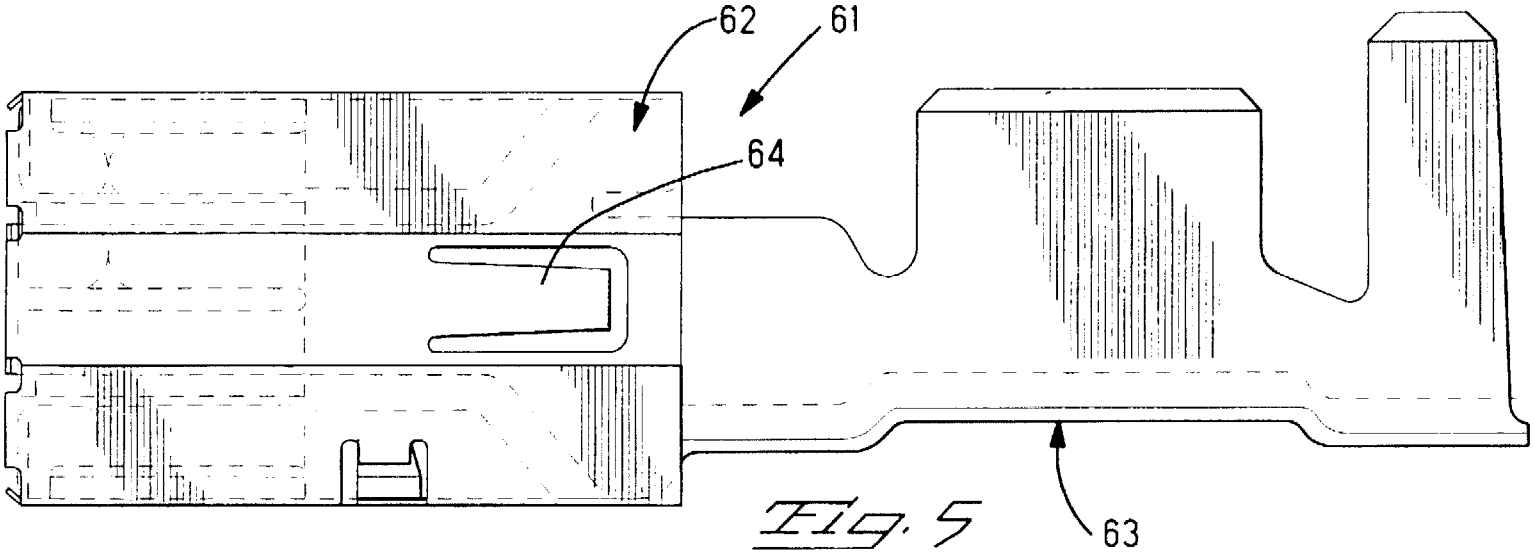
FIG. 5 is a side view of an alternative embodiment of an electrical connector according to the present invention incorporating an outer protective shell thereupon; and, FIG. 6 is a top sectional view of the electrical contact of FIG. 5.
Figure 6:
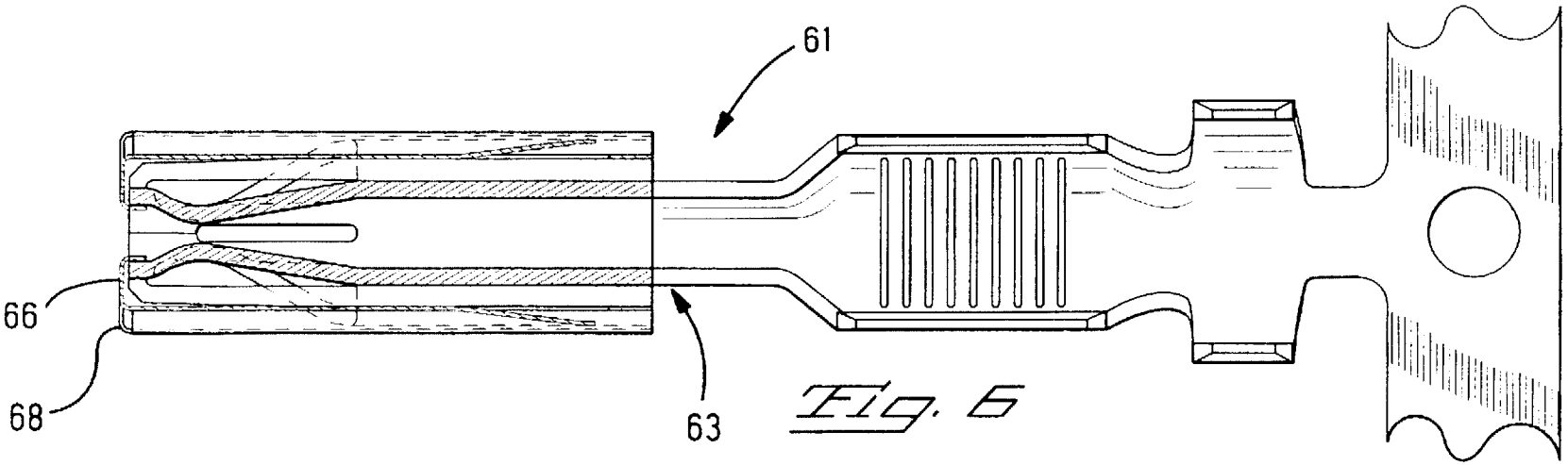

With reference now to FIGS. 5 and 6, an alternative embodiment is shown generally at 61. The contact 61 includes an outer protective shell 62 about an inner contact 63. The inner contact 63 is configured basically as described above. However, in this embodiment, the a locking lance 64 is carried on the protective shell 62. The protective shell further includes overhangs 66, 68, that wrap around the front ends of the contact arms where the tab would be received in a manner well known in the art.

Advantageously then, the present invention provides an electrical contact having at least three contact arms for engaging a tab terminal along a common side where the middle contact arm is provided enhanced stiffness. A contact according to the present invention may be further configured so that the contact arms act independently of each other, thereby assuring that the desired number of contact points are achieved. In addition, the contact is of simple construction and manufacture.

We claim:

1. An electrical receptacle contact for engaging a complementary tab terminal comprising a contact portion and a conductor engaging portion, where the contact portion includes a body and at least three adjacently arranged contact arms including a pair of spaced-apart outer contact arms extending from the body with contact an inner contact arm extending therebetween and the contact arms have contact surfaces thereupon for engaging a common side of the tab terminal, where a transverse support rail is provided along the inner contact arm and between the outer contact arms such that the inner contact arm is supported independently of the adjacent outer arm to provide enhanced stiffness.

2. The receptacle contact of claim 1, wherein the contact arms are independent of each other.

3. The receptacle contact of claim 1, wherein the body from which the contact arms extend, the body having a pair of spaced apart raised portion from which the outer contact arms extend and a channel therebetween from which the inner contact arm extends.

4. The receptacle contact of claim 3, wherein the body includes a transition portion between the raised portion and the channel, where the transition portion is formed into a supporting rail as the rail extends along the inner contact arm.

5. The receptacle contact of claim 1, wherein the three contact arms make up a first set of contact arms and the receptacle contact further includes a second set of similarly configured contact arms disposed opposite from the first set to form a tab receiving region therebetween.

6. The receptacle contact of claim 3, wherein the inner contact is divided lengthwise so that a first inner contact arm and a second inner contact arm are defined adjacent one another.

7. The receptacle contact of claim 6, wherein the second inner contact arm is also supported by a corresponding transverse support rail, the transverse support rail being positioned along the inner contact arm adjacent the adjacent outer contact arm.

8. The receptacle contact of claim 7, wherein the outer contact arms are supported by transverse rails.

9. The receptacle contact of claim 8, wherein the receptacle contact is of one piece construction.

10. The receptacle contact of claim 5, wherein the inner contact arm of each set are divided lengthwise into first and second inner contact arm.

11. The receptacle contact of claim 10, wherein the first and the second inner contact arm are both supported by a transverse support rail.

12. The receptacle contact of claim 11, wherein the outer contact arms are supported by transverse rails.

13. The receptacle contact of claim 11, wherein the transverse support rails extend from the body free of the corresponding inner contact arms and are joined thereto in the vicinity of an end of the inner contact arm.

14. The receptacle contact of claim 13, wherein the outer contact arms include transverse support rails extending from the base free of the corresponding contact arms and being joined thereto in the vicinity of an end of the contact arm.

15. The receptacle contact of claim 14, wherein an outer shell is provided about the contact portion.

* * * * *